US009511484B2

(12) United States Patent
Marchant et al.

(10) Patent No.: US 9,511,484 B2
(45) Date of Patent: Dec. 6, 2016

(54) RATCHETING SCREWDRIVER

(71) Applicants: Kevin Marchant, Sturtevant, WI (US); Steve Landowski, Racine, WI (US)

(72) Inventors: Kevin Marchant, Sturtevant, WI (US); Steve Landowski, Racine, WI (US)

(73) Assignee: MedTorque, Inc., Kenosha, WI (US)

( * ) Notice: Subject to any disclaimer, the term of this patent is extended or adjusted under 35 U.S.C. 154(b) by 121 days.

(21) Appl. No.: 14/618,043

(22) Filed: Feb. 10, 2015

(65) Prior Publication Data

US 2016/0229036 A1 Aug. 11, 2016

(51) Int. Cl.

| | |
|---|---|
| ***B25B 13/00*** | (2006.01) |
| ***B25B 15/04*** | (2006.01) |
| *B25B 17/02* | (2006.01) |
| *B25B 13/46* | (2006.01) |

(52) U.S. Cl.

CPC ..... *B25B 15/04* (2013.01); *B25B 13/461* (2013.01); *B25B 13/462* (2013.01); *B25B 17/02* (2013.01)

(58) Field of Classification Search

CPC ..... B25B 15/04; B25B 17/00; B25B 17/02; B25B 13/462; B25B 13/461

See application file for complete search history.

(56) References Cited

U.S. PATENT DOCUMENTS

| | | | | | |
|---|---|---|---|---|---|
| 3,702,546 | A * | 11/1972 | Schnepel | F16D 7/08 | 464/36 |
| 3,942,337 | A * | 3/1976 | Leonard | B25B 23/141 | 464/36 |
| 4,063,474 | A | 12/1977 | Klopping | | |
| 4,517,865 | A * | 5/1985 | Huang | B25B 15/02 | 81/475 |
| 4,641,551 | A * | 2/1987 | Pascaloff | B25B 23/141 | 408/126 |
| 6,095,020 | A | 8/2000 | Rinner | | |
| 6,132,435 | A * | 10/2000 | Young | A61B 17/8875 | 192/56.54 |
| 6,640,674 | B1 | 11/2003 | Rinner et al. | | |
| 7,243,581 | B1 * | 7/2007 | Gao | B25B 23/141 | 192/38 |
| 7,272,998 | B1 * | 9/2007 | Gauthier | B25B 23/1427 | 81/473 |
| 7,272,999 | B2 * | 9/2007 | Cutler | B25B 15/02 | 81/467 |
| 7,334,509 | B1 * | 2/2008 | Gao | B25B 15/02 | 81/467 |
| 7,487,700 | B2 * | 2/2009 | Cutler | B25B 23/1427 | 81/467 |
| 7,516,676 | B2 | 4/2009 | Gao | | |
| 7,650,821 | B2 | 1/2010 | Gauthier et al. | | |
| 8,475,466 | B2 * | 7/2013 | Chenaux | A61B 17/8875 | 606/104 |
| 8,714,056 | B2 | 5/2014 | Landowski | | |
| 2014/0116205 | A1 * | 5/2014 | Wang | B25B 13/462 | 81/63.1 |

* cited by examiner

*Primary Examiner* — Hadi Shakeri
*Assistant Examiner* — Danny Hong
(74) *Attorney, Agent, or Firm* — Jansson Munger McKinley & Kirby Ltd.

(57) ABSTRACT

A ratcheting screwdriver having a drive shaft for transmitting motion and torque as well as two annular drive gears and an annular driven gear, the drive gears and driven gear each have gear-engaging teeth. The drive gears have tabs and the driven gear has a plurality of flat-members. The drive gears and driven gear each have an opening that the drive shaft passes through. The screwdriver also includes at least two actuation balls and one stop ball partially disposed within a ball-housing support member, the ball housing member has an internal cavity to house the components. A user turns handle to transmit rotational torque to the tabs on the drive gears, the gear-engaging teeth of the drive gears transmit torque to the driven gear and the flat-members on the driven gear transmit torque to the drive shaft.

13 Claims, 7 Drawing Sheets

RATCHETING SCREWDRIVER

FIELD

This device is related generally to medical instruments for use in the medical field for surgical procedures and, more particularly, to a ratcheting screwdriver for surgical applications.

BACKGROUND

The use of surgical instruments including hand tools for various orthopedic uses is well-known in the art. Surgical hand tools, such as ratcheting screwdrivers are used for a variety of reasons in surgical settings. Ratcheting screwdrivers with gear mechanisms or the like, elongated handles and internal springs are well-known in the art. Some screwdrivers of the prior art include an adjustment mechanism which allows the user to ratchet in one or both directions. Most screwdrivers of the prior art use a gear with gear teeth that engage two pawls, or actuators, that move in and out of the teeth. The pawls typically consist of only a few number of teeth, and over time, the teeth can roll over or wear away until the ratchet no longer functions properly. There is a need for a ratcheting screwdriver which is stronger and more durable than existing ratcheting screwdrivers.

The present device provides a ratcheting screwdriver with teeth that are radially located on all gears, allowing many teeth to be engaged at one time and greatly increasing the strength of the ratcheting screwdriver. The screwdriver of the present device also includes three gears. A driven gear with teeth on both sides and two drive gears on either side of the driven gear. The drive gears also include gear teeth around the outer perimeter of the gear. This structure allows many teeth to be in contact with each other at any given time which results in a stronger and more durable screwdriver. The present device also uses spherical balls to move the gears back and forth and includes a tapered surface on the sides of the drive gears to more smoothly facilitate this.

In summary, there are problems and shortcomings in ratcheting screwdrivers of the prior art for use in medical settings to which this device is directed.

SUMMARY

This device is a ratcheting screwdriver having a housing being a handle with a proximal end and a distal end, the proximal end connected to a drive shaft for transmitting motion and torque and the distal end having a cap. The device includes two annular drive gears and an annular driven gear disposed between the drive gears, the drive gears and driven gear each have gear-engaging teeth around their outer edges, the drive gears including tabs and the driven gear having a plurality of flat-members around the inner surface of the driven gear that contacts the drive shaft, the drive gears and driven gear each having an opening that the drive shaft passes through. The device also includes at least one spring holding each drive gear in engagement with the driven gear; at least two actuation balls and one stop ball partially disposed within a ball-housing support member, the ball housing member having an internal cavity to house the drive gears, driven gear and at least one spring; and a directional control cap over and around the ball-housing member, actuation balls and stop ball. The user turns the handle to transmit rotational torque to the tabs on the drive gears, the gear-engaging teeth of the drive gears transmit torque to the driven gear and the flat-members on the driven gear transmit torque to the drive shaft.

In highly-preferred embodiments, the ball-housing support member includes slots which engage the tabs of each drive gear, the drive gears can move back and forth axially within the slots, the slots having side surfaces which push against the tabs of each drive gear to transmit rotational torque from the ball-housing support member to the drive gears. Preferred embodiments include four slots but could include a plurality of slots with a minimum of two.

Preferably, the device includes a gear-engagement surface and a non-engagement surface on each drive gear, the gear-engagement surface contacts the driven gear and the non-engagement is biased by the at least one spring.

In highly-preferred embodiments, the tabs on the drive gears are tapered surfaces that the actuation balls contact. Preferably, the actuation balls push against the tapered surfaces on the drive gears when the balls are moved toward a centerline of the drive gear thereby causing the drive gears to move axially away from the driven gear resulting in disengagement of the teeth, when the actuation balls move away from the centerline of the drive gears the spring force holds the gear teeth of the drive gears and driven gear in engagement with each other. The stop ball prevents the directional control cap from over rotation. It is also preferable that the driven gear is rotationally fixtured to the drive shaft by the plurality of flat-members.

In preferred embodiments, when the screwdriver is in a locked position it functions as a fixed screwdriver which cannot ratchet when both drive gears are engaged with the driven gear. Preferably, the screwdriver can ratchet in either a forward or a reverse direction when only one drive gear is engaged with the driven gear. It is highly preferred that one drive gear enables forward ratcheting of the screwdriver and the second drive gear enables reverse ratcheting of the screwdriver.

In preferred embodiments, the drive shaft has a first end and a second end, the first end connected to the handle and the second end in contact with a coupler. It is also preferable that a retaining ring groove hold the directional control cap in engagement with the ball-housing member.

The ratcheting screwdriver of this application has significant advantages over screwdrivers of the prior art.

BRIEF DESCRIPTION OF THE DRAWINGS

The drawings illustrate a preferred embodiment including the above-noted characteristics and features of the device. The device will be readily understood from the descriptions and drawings. In the drawings.

DETAILED DESCRIPTION OF PREFERRED EMBODIMENTS

Figure 1:
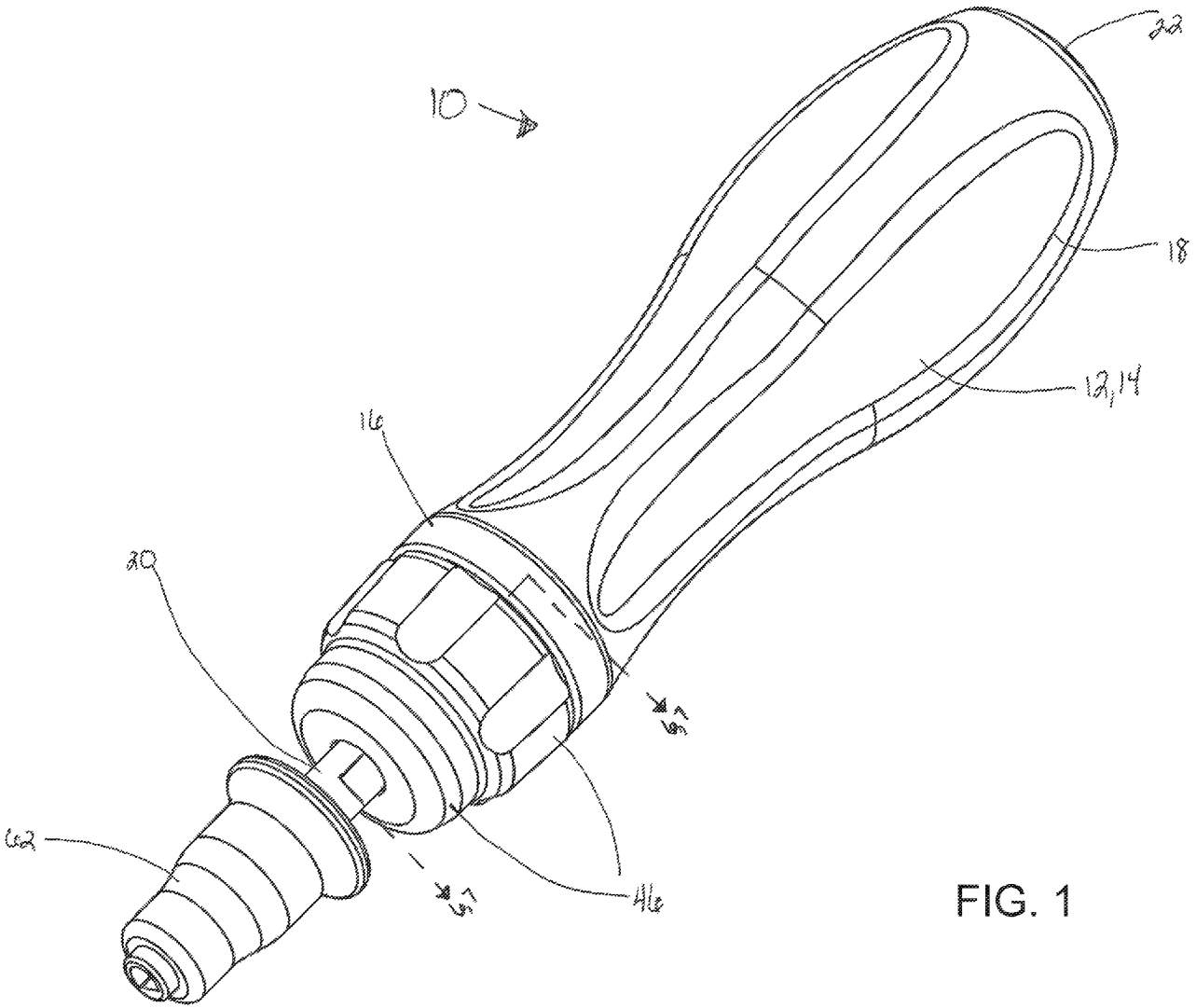
FIG. 1 is a perspective view of an assembled ratcheting screwdriver.

FIGS. 1-7 illustrate a ratcheting screwdriver 10 having a housing 12 that is a handle 14. Handle 14 includes proximal end 16 and distal end 18, proximal end 16 is connected to drive shaft 20 for transmitting motion and torque and distal end 18 has a cap 22. Driver 10 also includes two annular drive gears 24 and an annular driven gear 26 disposed between drive gears 24. Drive gears 24 and driven gear 26 each have gear-engaging teeth 28 around the outside surface of each gear. Drive gears 24 include tabs 30 and driven gear 26 has a plurality of flat-members 32 around the inner surface of driven gear 26 which contacts drive shaft 20. Drive gears 24 and driven gear 26 each have opening 34 that drive shaft 20 passes through. Driver 10 also includes at least one spring 36 holding each drive gear 24 in engagement with driven gear 26 as well as at least two actuation balls 38 and one stop ball 40 partially disposed within ball-housing support member 42. Ball-housing support member 42 includes internal cavity 44 to house drive gears 24, driven gear 26 and spring(s) 36. Directional control cap 46 fits over and around ball-housing support member 42, actuation balls 38 and stop ball 40. A user turns handle 14 to transmit rotational torque to tabs 30 on drive gears 24, gear-engaging teeth 28 of drive gears 24 transmit torque to driven gear 26 and flat-members 32 on driven gear 26 transmit torque to drive shaft 20.

FIG. 1 illustrates the interaction between handle 14, directional control cap 46, drive shaft 20 and coupler 62. Directional control cap 46 can be rotated into three positions; forward, reverse, and locked. Handle 14 shown can be replaced with a plurality of different handle types with various shapes and sizes. Coupler 46 is intended to securely connect a customer's shaft onto driver 10. Coupler 46 represents one particular style of a coupler and is shown for visual reference only. It can be designed for a plurality of shafts or it can be removed altogether, based upon each customer's unique requirements. Drive shaft 20 is connected on a first end 58 to coupler 46 and on a second end 60 to handle 14 as seen in FIGS. 1-2.

Figure 2:
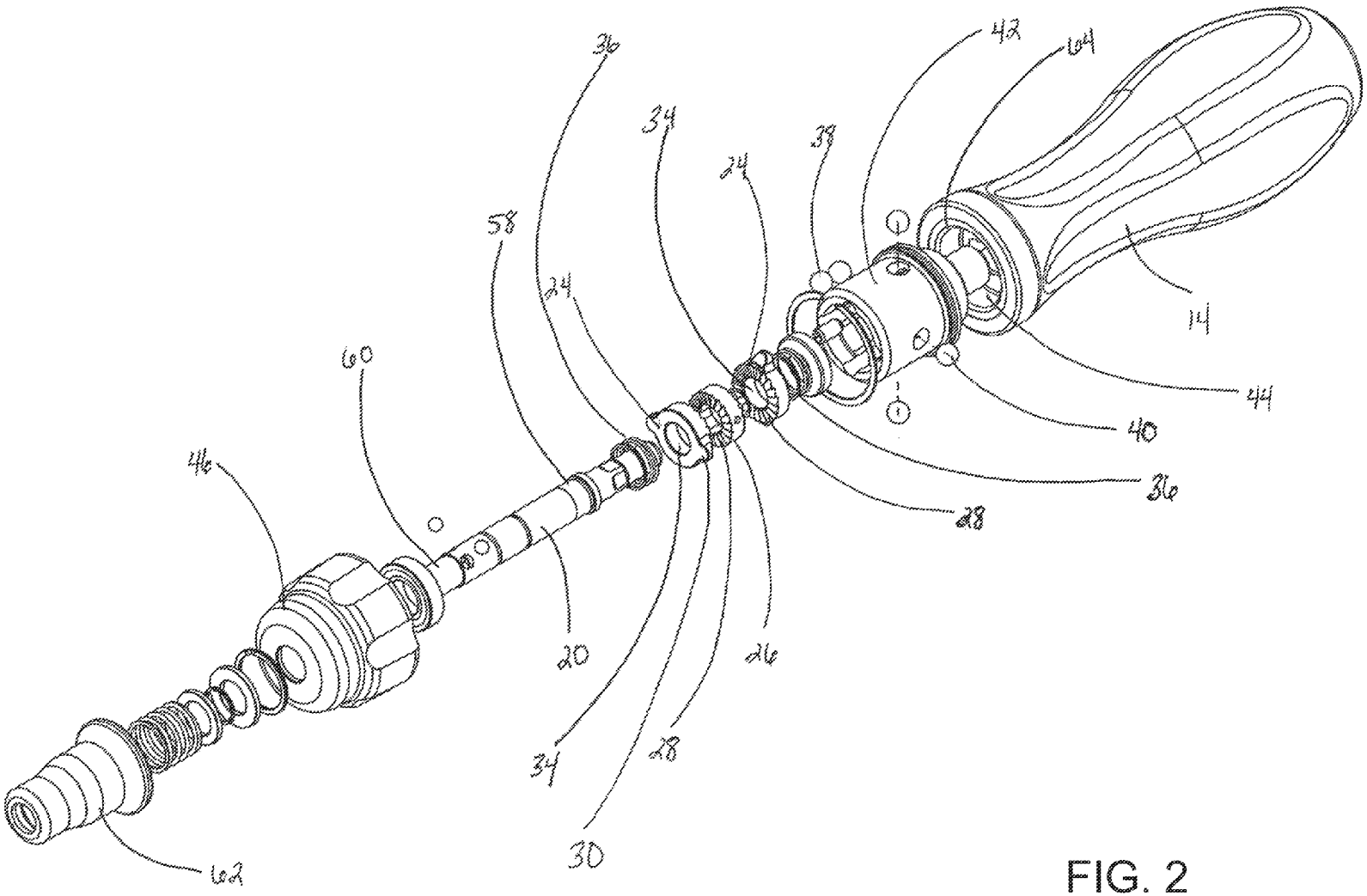
FIG. 2 is an exploded view of the screwdriver of FIG. 1.

FIG. 2 illustrates the interaction of various structural components of driver 10. Housing 12 has internal cavity 44 for containing the internal components and includes holes in the sides of ball-housing support member 42 for actuation balls 38 and stop ball 40. Ball-housing support member 42 has four slots 48 on internal cavity 44 of housing 12 which mate with tabs 30 of drive gears 24. Slots 48 can consist of a minimum of two slots 48 but can also be a plurality of slots 48. Each gear 24 has at least one tab 30 but can also have a plurality of tabs 30 as well. FIGS. 2-5 illustrate that drive gears 24 move back and forth axially within slots 48. As seen best in FIG. 5, side surfaces 50 of slots 48 push against tabs 30 of drive gears 24 to transmit rotational torque from housing 12 to drive gears 24. Housing 12 also includes retaining ring groove 64 which interacts with ball-housing support member 42.

Figure 3:
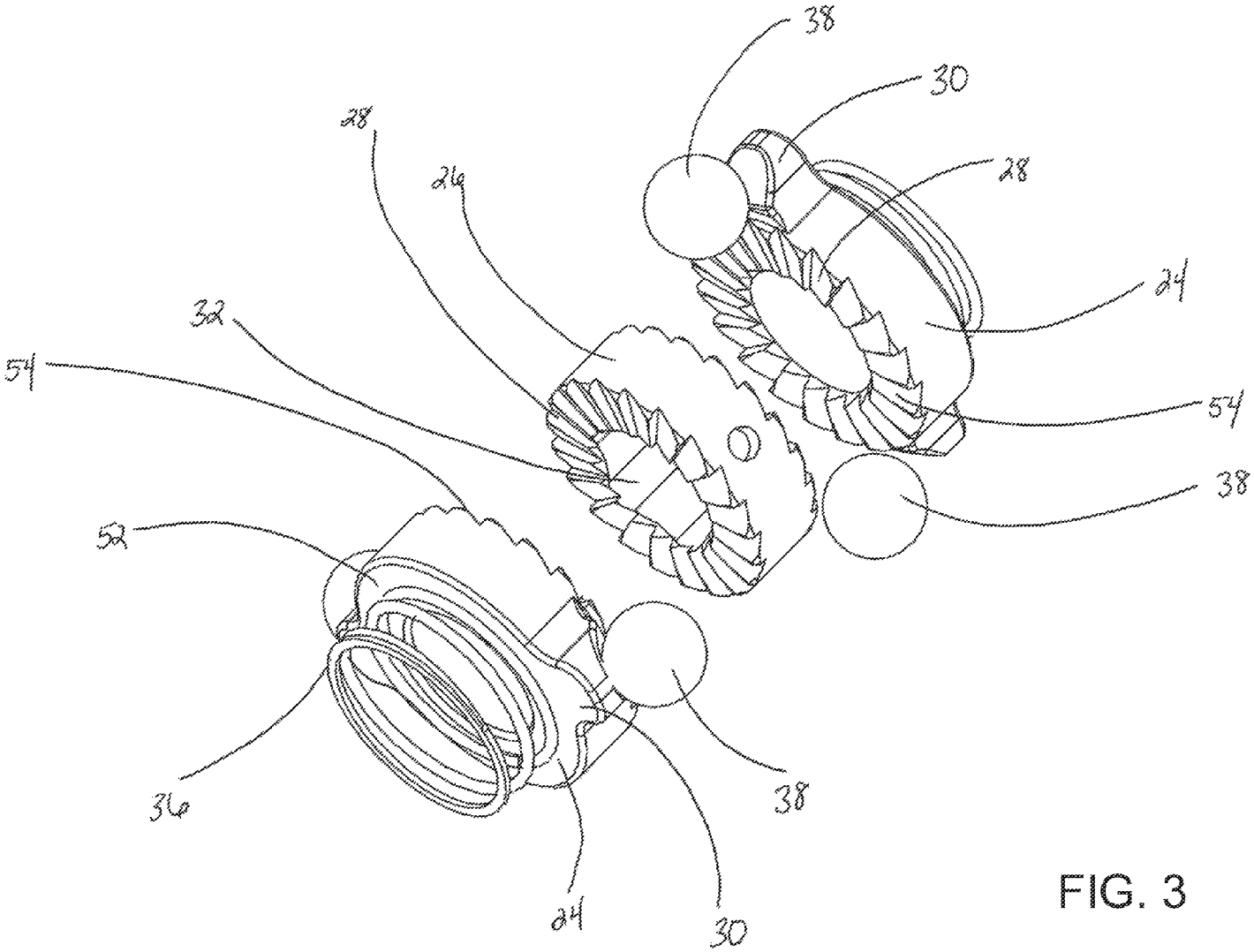
FIG. 3 is an exploded view of the driven gear and drive gears of the screwdriver of FIG. 1.

One of the two drive gears 24 is utilized as the "forward" ratchet gear and the other drive gear 24 is the "reverse" ratchet gear as seen in FIG. 3. FIG. 3 also illustrates that driven gear 26 is disposed between the two drive gears 24 and is rotationally fixtured to shaft 20 with a plurality of flats 32. Springs 36 are located on either side of both drive gears 24 to push drive gears 24 into engagement with driven gear 26. When both of the drive gears 24 are engaged with driven gear 26, driver 10 is in the "locked" position and functions as a fixed driver (does not ratchet). If one of the drive gears 24 is moved out of engagement with driven gear 26 driver 10 can ratchet in either the forward or reverse direction. FIG. 3 shows that each drive gear 24 has a gear-engagement surface 52 and a non-engagement surface 54. Gear-engagement surface 52 contacts driven gear 26 and non-engagement surface 54 is biased by spring(s) 36. FIG. 2 also illustrates that driven gear 26 is rotationally fixtured to drive shaft 20 by a plurality of flat-members 32 or it can also be rotationally fixtured by using a pin (not shown).

Figure 4:
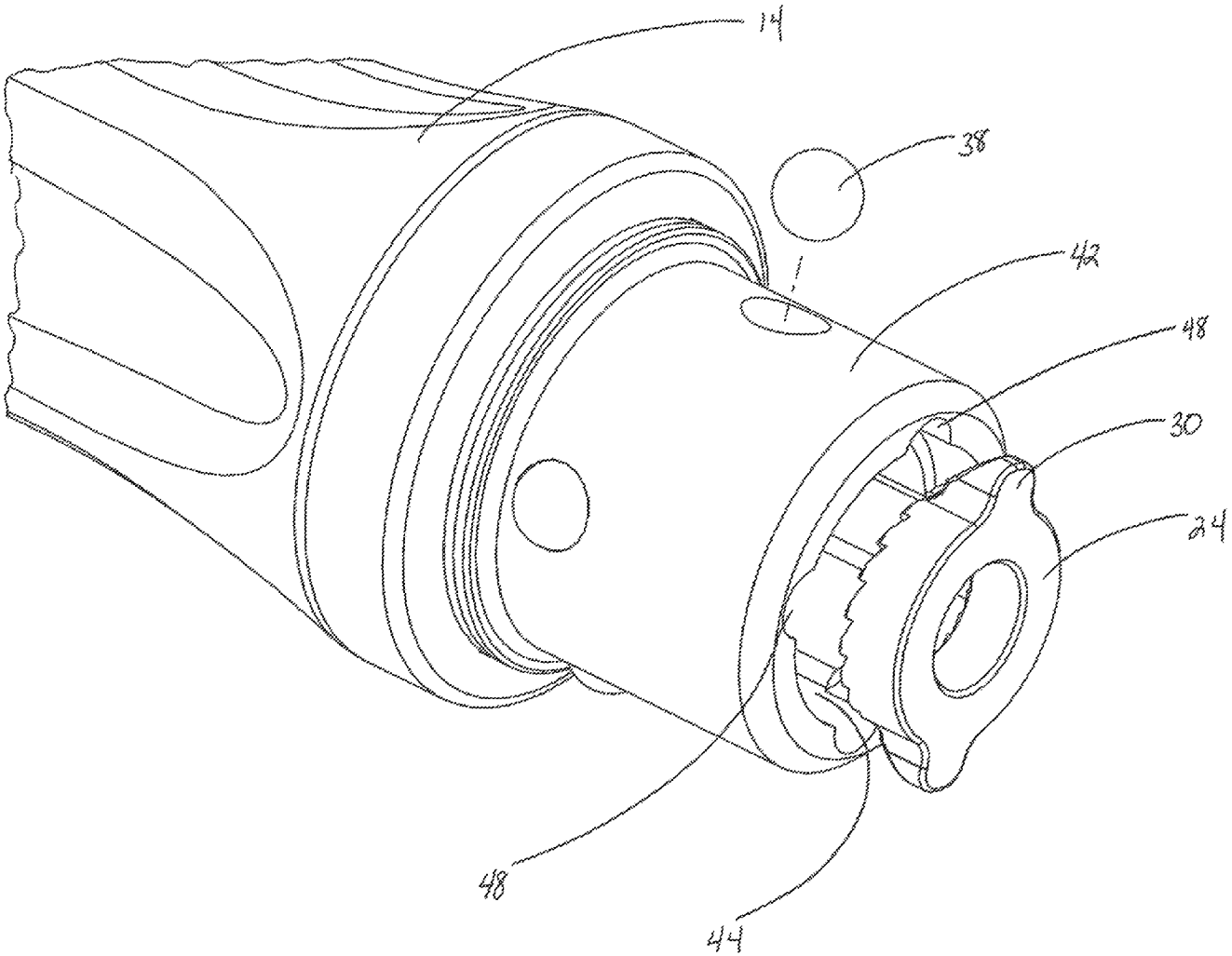
FIG. 4 is a perspective view of the ball-housing support member of the screwdriver of FIG. 1.

FIG. 4 illustrates ball-housing support member 42 and illustrates actuation balls 38 and stop ball 40. Actuation balls 38 and stop ball 40 sit in recessed holes in ball-housing support member 42. The holes for actuation balls 38 and stop ball 40 do not go all the way through ball-housing support member 42 into internal cavity 44. Actuation balls 38 seat against tapered surfaces on tabs 30 of drive gears 24. FIG. 4 illustrates tabs 30 on a drive gear 24 and how tabs 30 engage slots 48.

As seen in FIG. 4, directional control cap 46 has slots 48 machined on internal cavity 44 which contact actuation balls 38 at all times. Slots 48 are machined at varying depths so that, as directional control cap 46 is turned, actuation balls 38 are either forced deeper into housing 12 or are moved outward. Springs 36 pushing against drive gears 24 force actuation balls 38 outward. The bushing and bearing seen in FIG. 2 are intended to control the concentric position of shaft 20 within housing 12. Stop ball 40 prevents directional control cap 46 from rotating too far in either direction.

Figure 5:
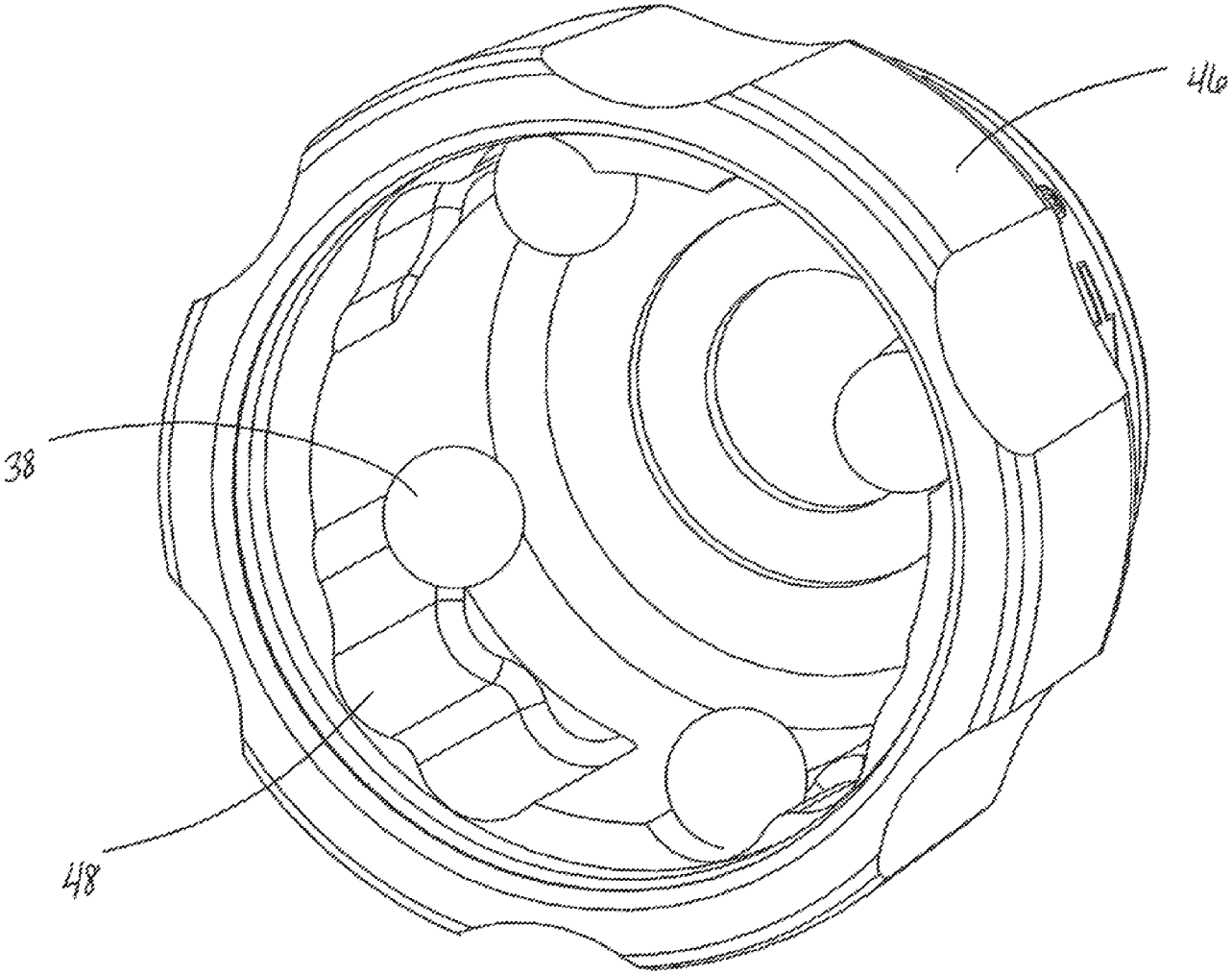
FIG. 5 is a perspective view of the directional control cap of the screwdriver of FIG. 1.

FIG. 5 shows the structural detail of the inside of directional control cap 46 and actuation balls 38 when in the "Reverse" ratchet direction. Actuation balls 38 push against tapered surfaces on drive gears 24 when actuation balls 38 are moved toward a centerline 56 of drive gear 24 thereby causing the drive gears 24 to move axially away from the driven gear 26 resulting in disengagement of gear teeth 28. When actuation balls 38 move away from the centerline 56 of drive gears 24 the force of spring 36 holds the gear teeth 28 of drive gears 24 and driven gear 26 in engagement with each other.

Figure 6:
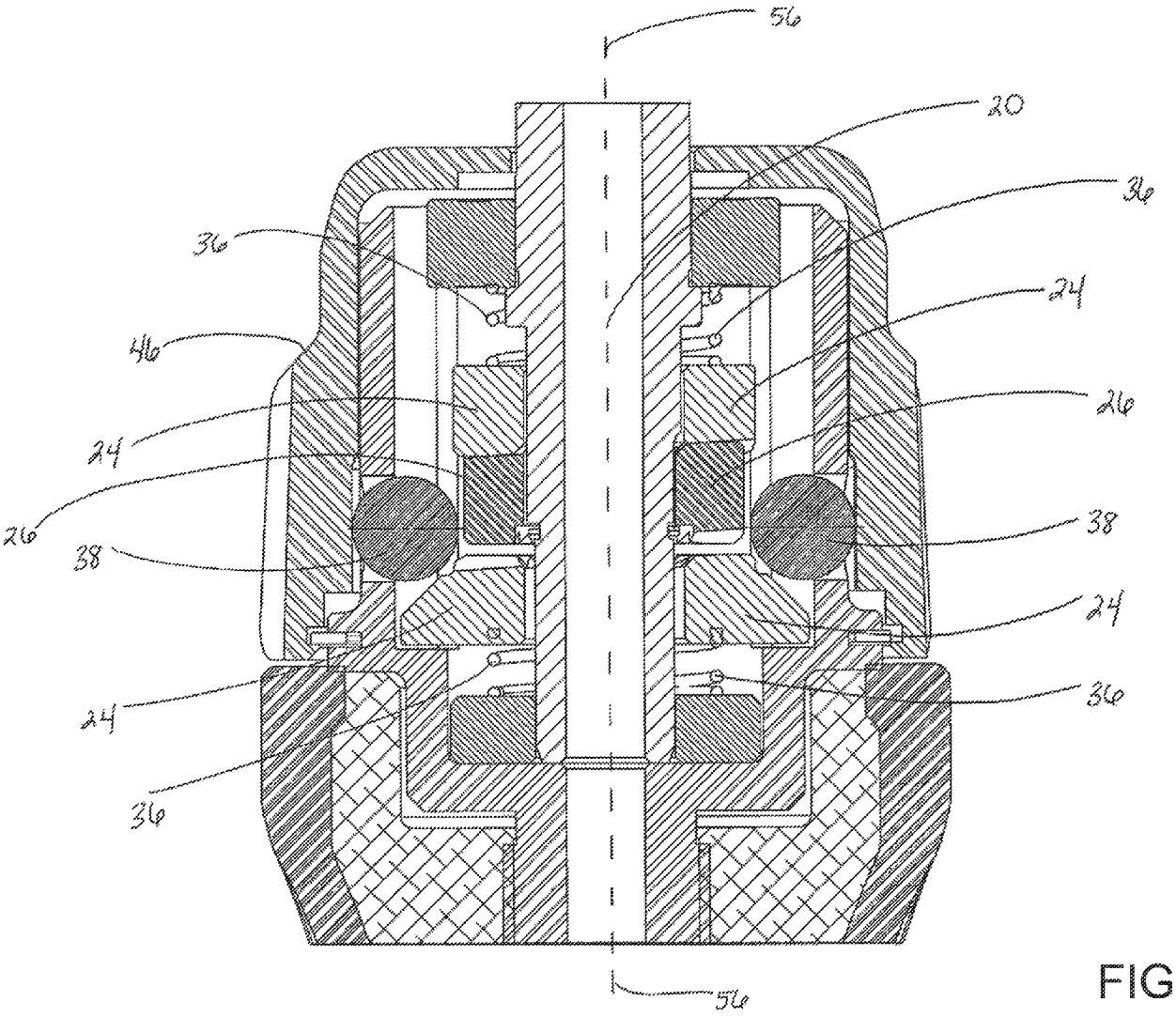
FIG. 6 is a cross-sectional view of the screwdriver taken along line 6-6 of FIG. 1.
Figure 7:
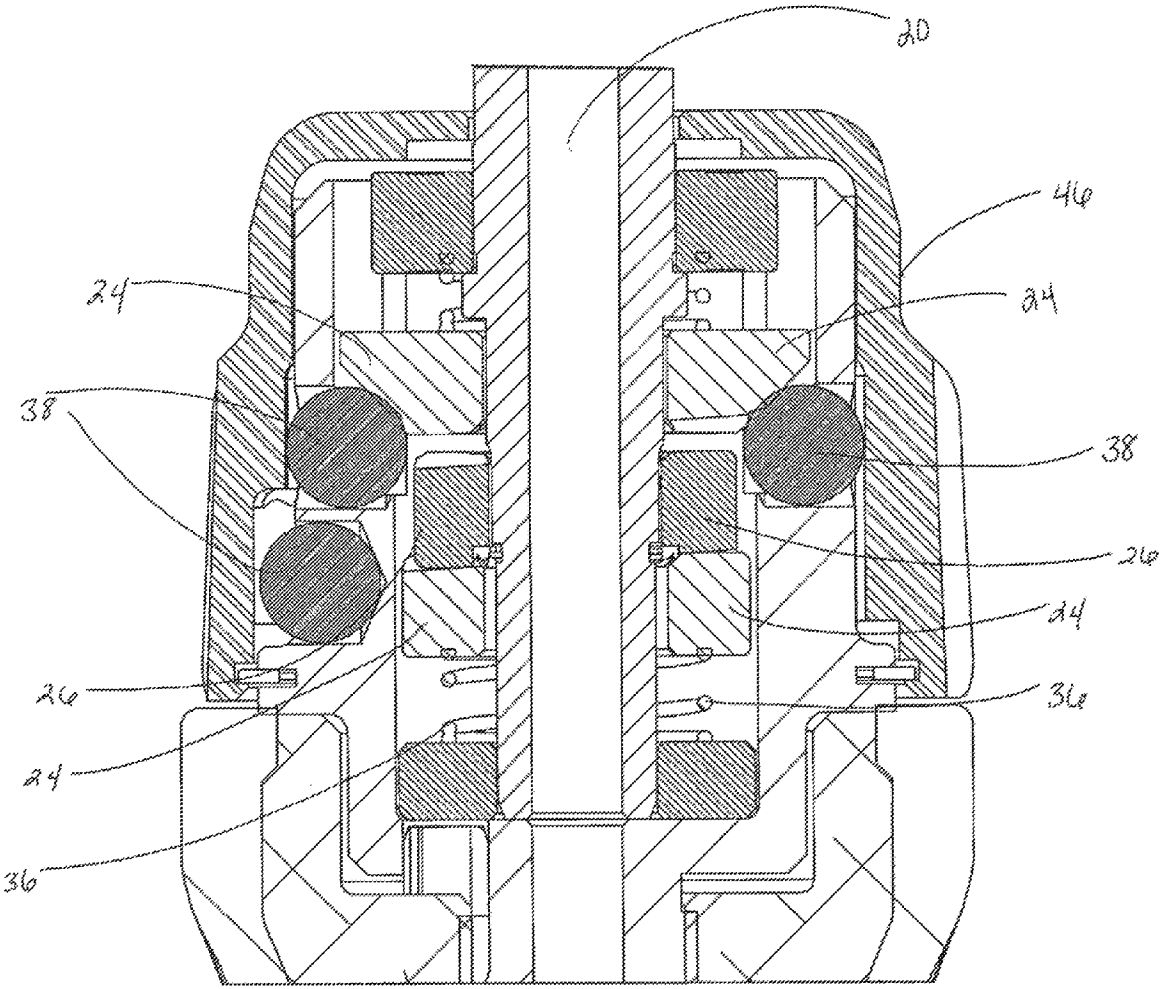
FIG. 7 is a cross-sectional view of the screwdriver taken along line 7-7 of FIG. 1.

FIG. 6 illustrates driver 10 in the "Forward" ratchet direction. The drive gear 24 shown on the bottom of FIG. 6 (the reverse drive gear) has been moved out of engagement with driven gear 26. In contrast, FIG. 7 shows driver 10 in the "Reverse" ratchet direction. The drive gear 24 shown at the top of FIG. 7 (the forward gear) has been moved out of engagement with driven gear 26. When driver 10 is in a locked position it functions as a fixed driver 10 which cannot ratchet when both drive gears 24 are engaged with driven gear 26.

FIGS. 6-7 also illustrate in detail interaction of actuation balls 38 pushing against the tapered surfaces when actuation balls 38 are moved towards the centerline 56 of drive gear 24. Such action causes drive gears 24 to move axially away from driven gear 26, thereby disengaging the gear teeth 28. When actuation balls 38 are moved away from the centerline 56 of drive gears 24, the force of the spring(s) pushes drive gear 24 toward driven gear 26 so that the gear teeth 28 are engaged.

FIGS. 6-7 illustrate tapered surface on the sides of each drive gear 24. Actuation balls 38 push against the tapered surfaces when actuation balls 38 are moved towards centerline 58 of drive gear 24.

A wide variety of materials are available for the various parts discussed and illustrated herein.

While the principles of this device have been described in connection with specific embodiments, it should be understood clearly that these descriptions are made only by way of example and are not intended to limit the scope of the device.

The invention claimed is:

1. A ratcheting screwdriver comprising:

a housing being a handle with a proximal end and a distal end, the proximal end being connected to a drive shaft for transmitting motion and torque and the distal end having a cap;

two annular drive gears and an annular driven gear disposed therebetween, the drive gears and driven gear each have gear-engaging teeth therearound, the drive gears including tabs and the driven gear having a plurality of flat-members therearound, the drive gears and driven gear each having an opening that the drive shaft passes through;

at least one spring holding each drive gear in engagement with the driven gear;

at least two actuation balls and one stop ball partially disposed within a ball-housing support member, the ball-housing support member having an internal cavity to house the drive gears, driven gear and at least one spring; and a directional control cap over and around the ball-housing support member, actuation balls and stop ball;

wherein the user turns the handle to transmit rotational torque to the tabs on the drive gears, the gear-engaging teeth of the drive gears transmit torque to the driven gear and the flat-members on the driven gear transmit torque to the drive shaft.

2. The screwdriver of claim 1 wherein the ball-housing support member includes slots which engage the tabs of each drive gear, the drive gears can move back and forth axially within the slots, the slots having side surfaces which push against the tabs of each drive gear to transmit rotational torque from the ball-housing support member to the drive gears.

3. The screwdriver of claim 1 further including a gear-engagement surface and a non-engagement surface on each drive gear, the gear-engagement surface contacts the driven gear and the non-engagement surface is biased by the at least one spring.

4. The screwdriver of claim 2 wherein the slots are at least two slots.

5. The screwdriver of claim 1 wherein the tabs on the drive gears are tapered surfaces that the actuation balls contact.

6. The screwdriver of claim 5 wherein the actuation balls push against the tapered surfaces on the drive gears when the balls are moved toward a centerline of the drive gear thereby causing the drive gears to move axially away from the driven gear resulting in disengagement of the teeth, when the actuation balls move away from the centerline of the drive gears the force exerted by the spring holds the gear teeth of the drive gears and driven gear in engagement with each other.

7. The screwdriver of claim 1 wherein the driven gear is rotational fixtured to the drive shaft by the plurality of flat-members.

8. The screwdriver of claim 1 wherein the screwdriver is in a locked position and functions as a fixed screwdriver which cannot ratchet when both drive gears are engaged with the driven gear.

9. The screwdriver of claim 1 wherein the screwdriver can ratchet in either a forward or a reverse direction when only one drive gear is engaged with the driven gear.

10. The screwdriver of claim 1 wherein one drive gear enables forward ratcheting of the screwdriver and the second drive gear enables reverse ratcheting of the screwdriver.

11. The screwdriver of claim 1 wherein the drive shaft has a first end and a second end, the first end connected to the handle and the second end in contact with a coupler.

12. The screwdriver of claim 1 wherein the stop ball prevents the directional control cap from over rotation.

13. The screwdriver of claim 1 further including a retaining ring groove to hold the directional control cap in engagement with the ball-housing support member.

* * * * *